US009650174B2

(12) United States Patent
Seelhofer et al.

(10) Patent No.: US 9,650,174 B2
(45) Date of Patent: May 16, 2017

(54) FILLABLE CLOSURE COMPRISING A PUSH BUTTON FOR TRIGGERING

(75) Inventors: Fritz Seelhofer, Lindau (CH); Wolfgang Zangerle, Mellingen (CH)

(73) Assignees: RIWISA AG, Hagglingen (CH); BEVASWISS AG, Neuhausen am Rheinfall (CH)

( * ) Notice: Subject to any disclaimer, the term of this patent is extended or adjusted under 35 U.S.C. 154(b) by 0 days.

(21) Appl. No.: 14/125,730

(22) PCT Filed: Jun. 1, 2012

(86) PCT No.: PCT/EP2012/060436

§ 371 (c)(1),
(2), (4) Date: Jan. 6, 2014

(87) PCT Pub. No.: WO2012/175317

PCT Pub. Date: Dec. 27, 2012

(65) Prior Publication Data

US 2014/0117020 A1 May 1, 2014

(30) Foreign Application Priority Data

Jun. 21, 2011 (EP) ..... 11170835

(51) Int. Cl.
*B65D 25/04* (2006.01)
*B65D 51/28* (2006.01)

(52) U.S. Cl.
CPC ..... *B65D 25/04* (2013.01); *B65D 51/2821* (2013.01)

(58) Field of Classification Search
CPC ..... A61J 1/201; A61J 1/1412; A61J 1/1418–1/1431; B65D 25/04; B65D 51/2821

(Continued)

(56) References Cited

U.S. PATENT DOCUMENTS 6,045,004 A * 4/2000 Elliott ..... 222/83
2003/0213709 A1* 11/2003 Gibler ..... B65D 51/2842 206/219

(Continued)

FOREIGN PATENT DOCUMENTS

DE 10 2007 028 707 B3 9/2008
FR 2 853 302 A1 10/2004

OTHER PUBLICATIONS

International Search Report (PCT/ISA/210) mailed on Aug. 8, 2012, by the European Patent Office as the International Searching Authority for International Application No. PCT/EP2012/060436.

*Primary Examiner* — Anthony Stashick
*Assistant Examiner* — James M Van Buskirk
(74) *Attorney, Agent, or Firm* — Buchanan Ingersoll & Rooney PC

(57) ABSTRACT

The fillable closure is used to trigger the emptying of a capsule that can be inserted in the closure and filled separately. The closure consists of a closing cap which can be attached to the neck of a container and in which a separately fillable capsule can be inserted in the closed state from beneath. The region above the inserted capsule on the closing cap forms a push button. A downwardly projecting protuberance is molded on the lower face. The protuberance abuts against the inserted capsule. Using pressure from above, the push button can be pressed to deform an initially convex shape as seen from above into a concave shape, the protuberance pushing the upper face of the capsule and the content thereof downward. A film, which forms the lower face of the capsule, is thus placed under tensile stress such that it breaks or bursts along weakened lines.

13 Claims, 12 Drawing Sheets

Figure 1:
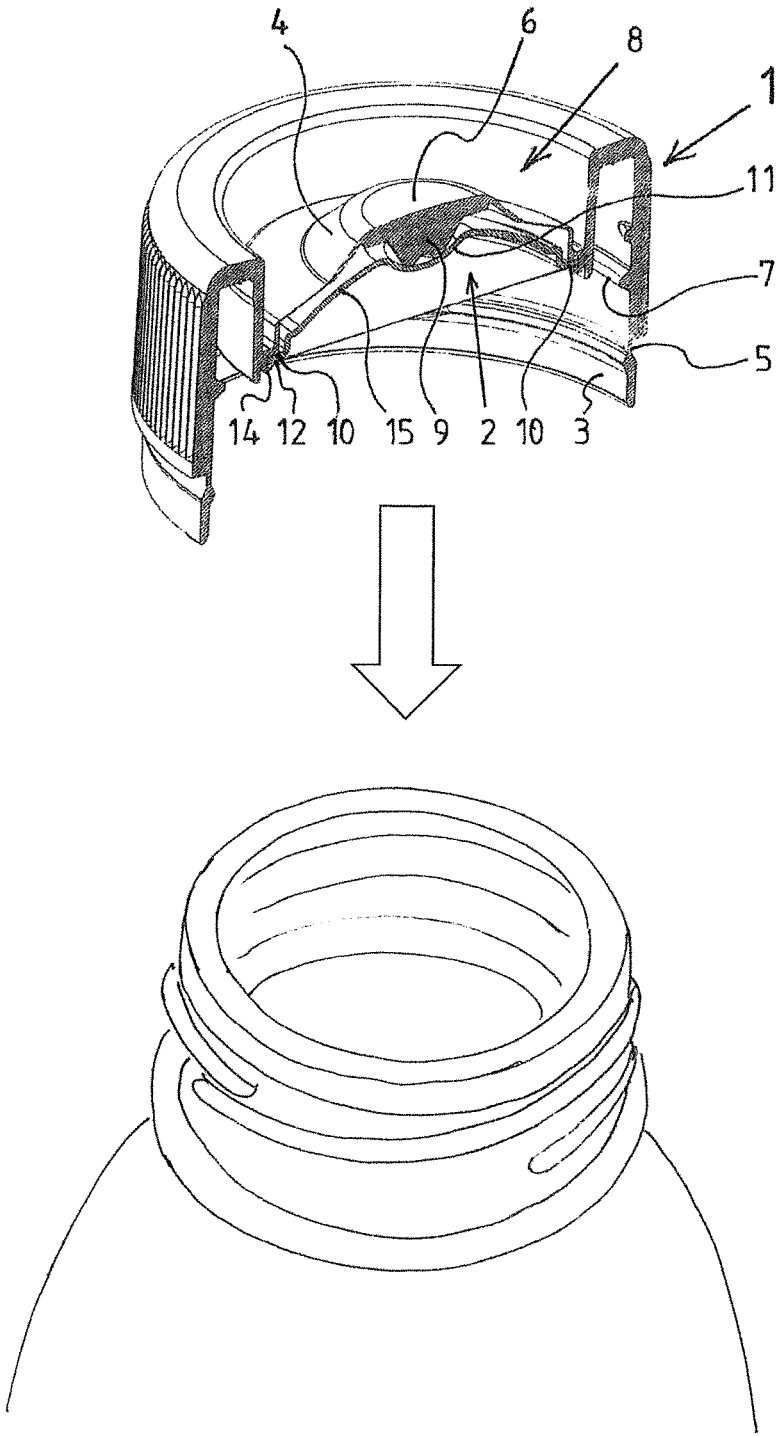

(58) Field of Classification Search
USPC ..... 206/532, 538; 215/214, 217, 253, 262;
220/266–267, 277–278, 521, 222
See application file for complete search history.

(56) References Cited

U.S. PATENT DOCUMENTS

| | | | | |
|---|---|---|---|---|
| 2007/0023381 | A1 | 2/2007 | Cerveny | |
| 2008/0223485 | A1* | 9/2008 | Nyambi et al. | 141/351 |
| 2010/0288767 | A1* | 11/2010 | Seelhofer | B65D 51/2821 220/212 |

* cited by examiner

FILLABLE CLOSURE COMPRISING A PUSH BUTTON FOR TRIGGERING

This invention relates to a fillable closure that can be triggered by means of a push button so that a separately filled small capsule inside the closure can thereby be opened and emptied in the container with which the closure is equipped. Many beverages are already being produced today by mixing a concentrate with water. Instead of distributing the ready-made mixture, it would be a lot more efficient if the bottlers could just bottle water onsite and add the concentrate to the water in the bottle and mix it for the consumer when opening the bottle for the first time.

A known solution for adding a separate liquid is a plastic dosing closure and appropriate container neck for a container. It consists of a threaded cap, a separately fillable capsule on the inside that can be closed with a film and/or after filling and an appropriate container neck. The capsule is kept within the container neck and faces downward together with its sealing film. A cap that is attached to the container neck protrudes into the inside of the container neck and the lower edge of the container neck has a piercing and cutting mechanism by means of which the sealing film can be opened from the bottom at the lower end of the capsule when opening the plastic dosing closure for the first time so that the substance contained in the capsule falls into container. At first, the threaded cap shifts downward on the container neck when turning counterclockwise—thus in the loosening direction—as a result of which the film of the capsule is pressed via a piercing and cutting mechanism and is, consequently, cut from the bottom while the threaded cap strikes against the container neck. When turning the threaded cap further in the loosening direction, this threaded cap will take along the container neck which, in turn, rests on the container nozzle whereby this continued turning requires a larger torque to unscrew the cap. If the threaded cap is turned further, it will take along the container neck and the empty capsule located therein and the entire closure is unscrewed from the container nozzle. However, the disadvantage of this solution is the fact that it is intricate in its construction and design, yet, left-hand and right-hand threads are necessary so that the threaded cap first moves downward when screwing it off counterclockwise and then moves upward by means of another thread when turning the cap further. The assembly of the closure is not without problems either.

The object of the present invention is to create a fillable closure to a capsule that can be filled separately and which is simple to produce and assemble, consists of a minimum number of parts and which can be used with a single operation—a single action—in such a way that the content of the filled capsule in the container, which is equipped with the closure, can be emptied. In addition, it should also be possible to make the capsule airproof and lightproof.

This task is solved by a fillable closure to trigger the emptying of a separately filled capsule that belongs to this closure, whereby the closure consists of a closing cap that can be screwed onto the threaded neck of a container and a separately filled capsule in closed state can be inserted in this closing cap with a downward-facing sealing film of the capsule and which is characterised by the fact that the closing cap features a deformable upper face that can be pressed downward while deforming in the centre whereby the upper face of the inserted capsule is also of a deformable design and can be pressed down in an axial motion so that the downward-facing sealing film of the capsule, which is provided with at least one weakened line, can be placed under tensile stress, and characterised by the fact that the sealing film breaks or bursts along at least one weakened line.

The figures show several variants of this fillable closure with a push button in multiple views. The closure is described in detail and its function is explained on the basis of these figures.

Figure 2:
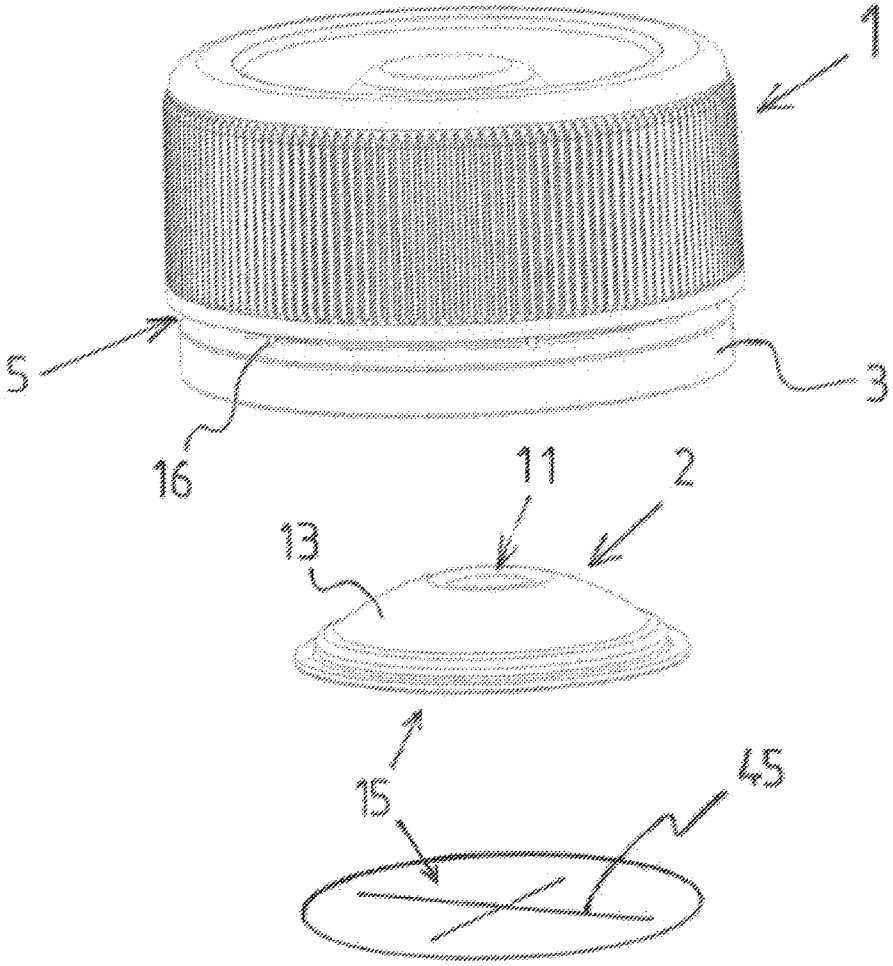
Figure 3:
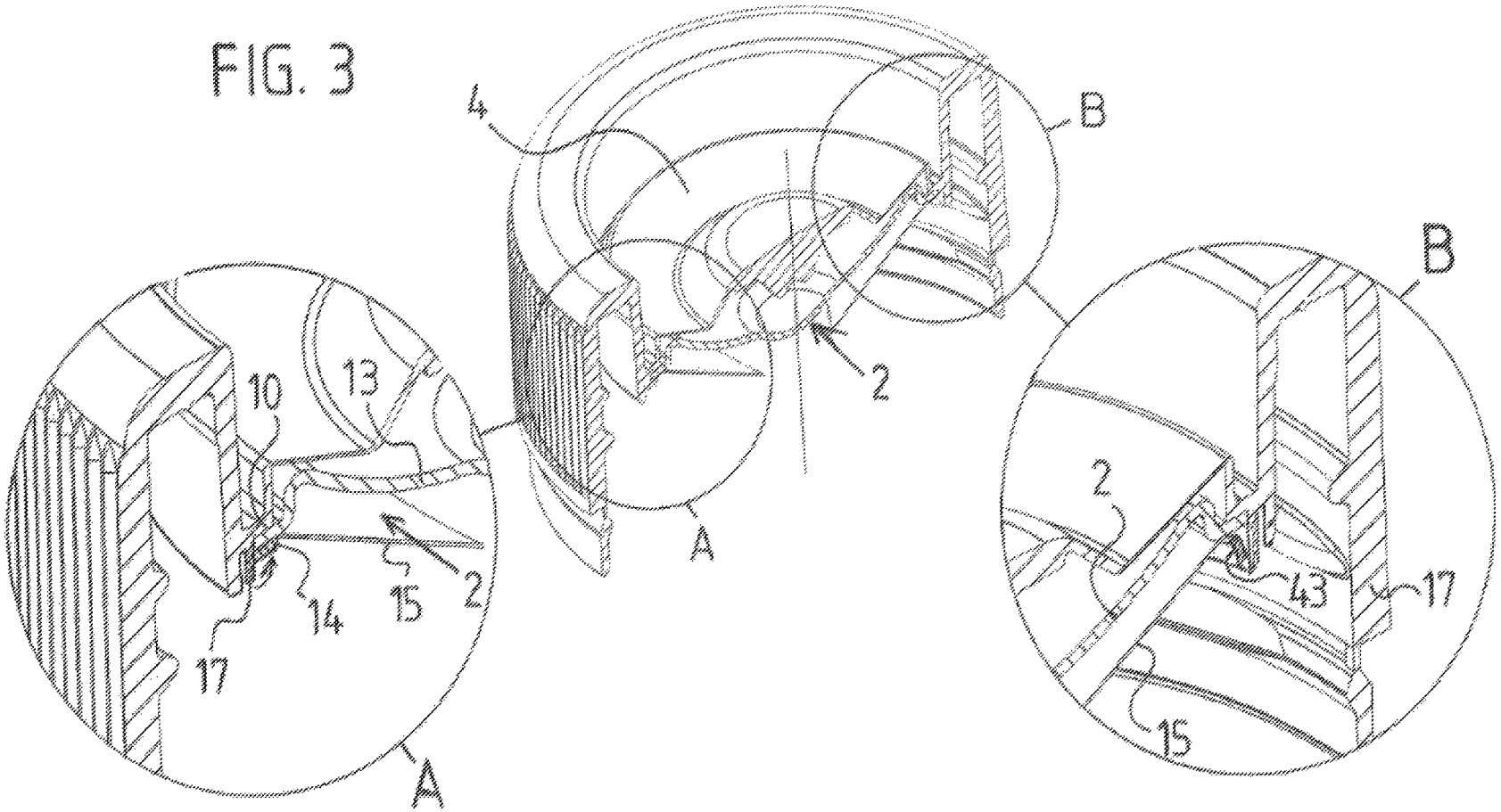
Figure 4:
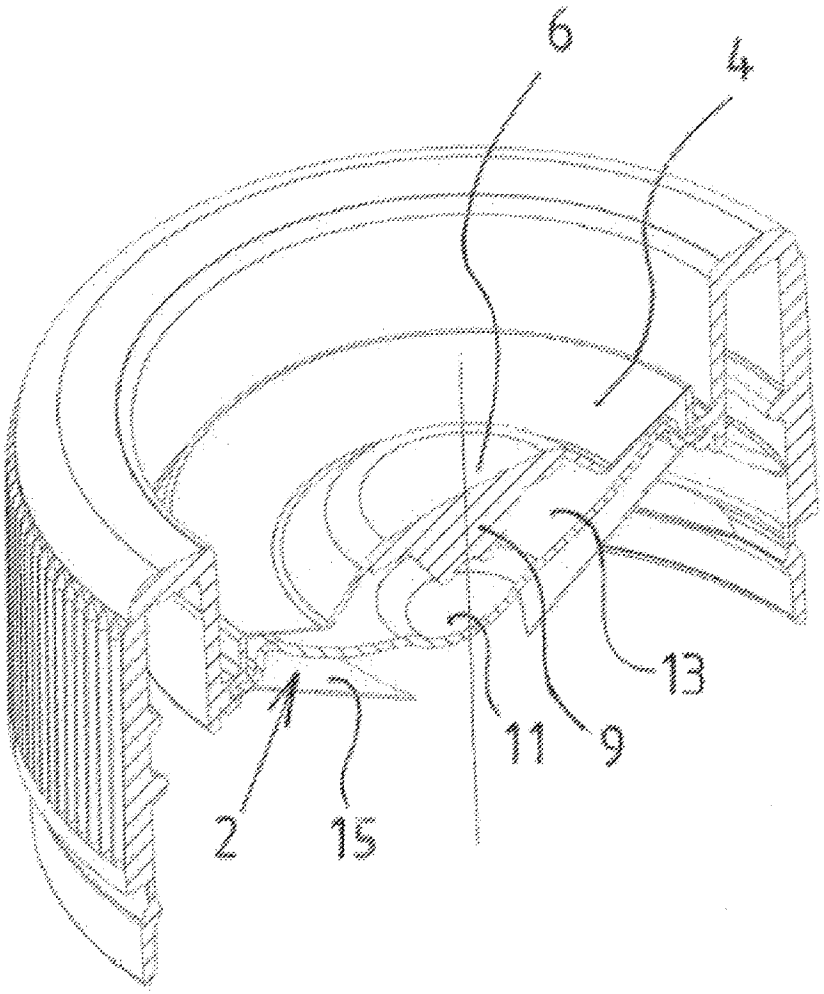
Figure 5:
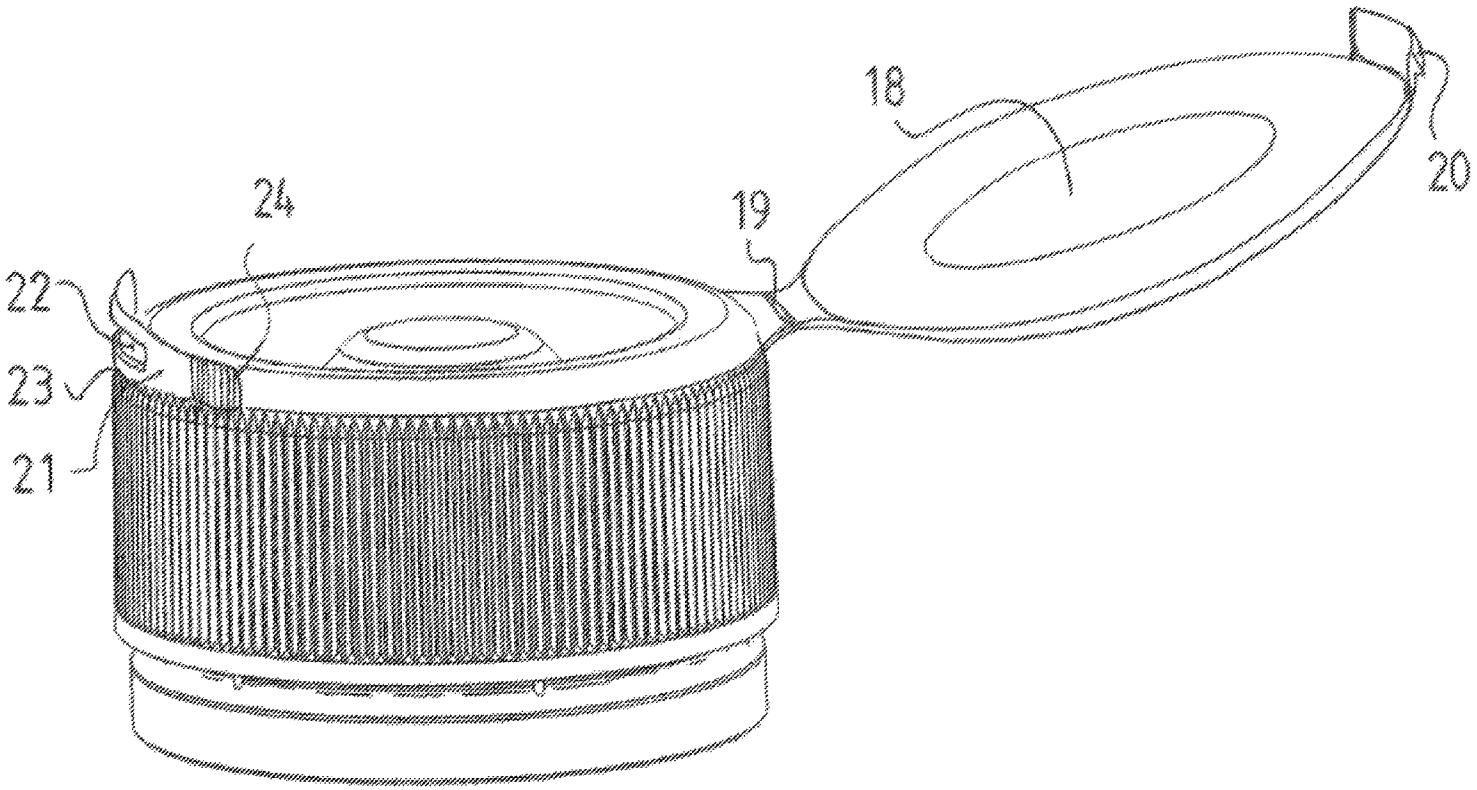
Figure 6:
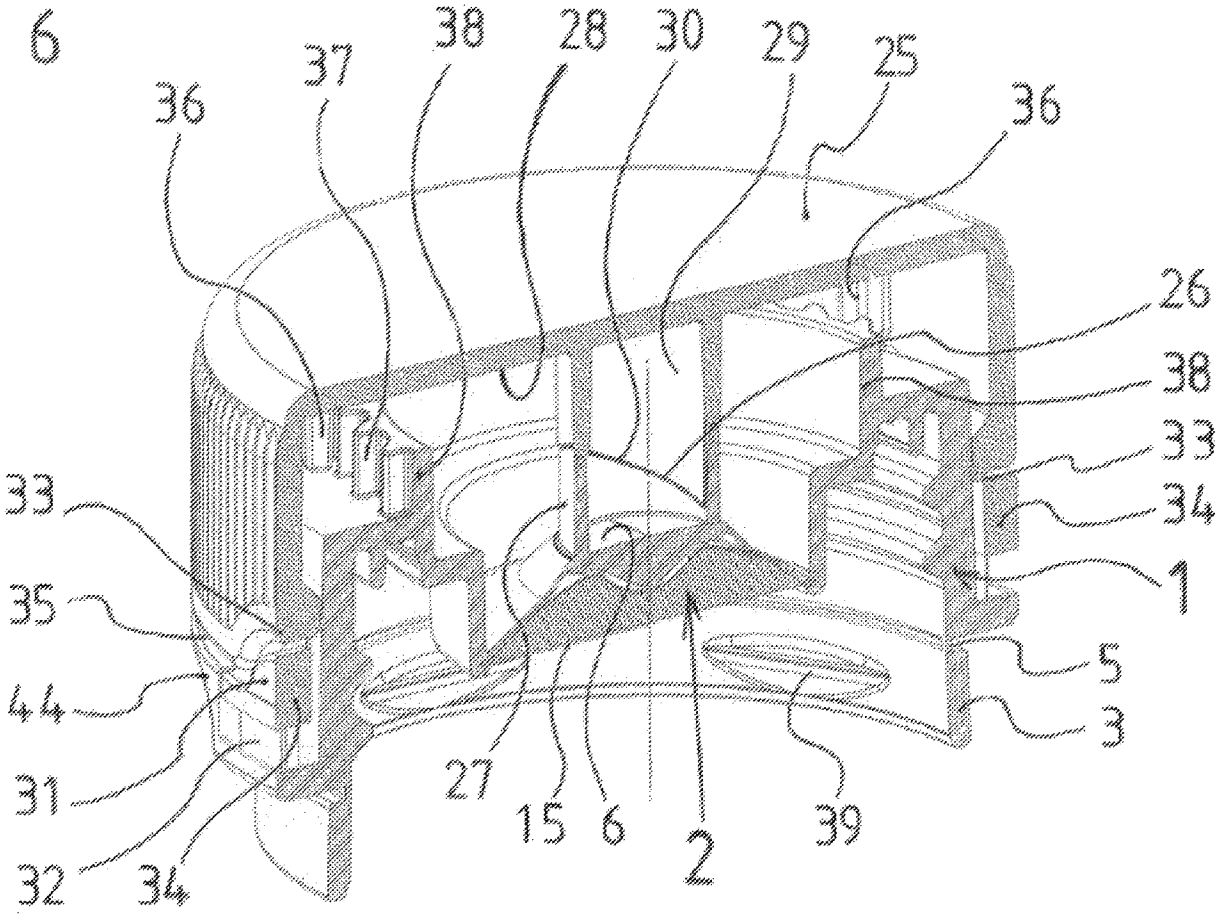
Figure 7:
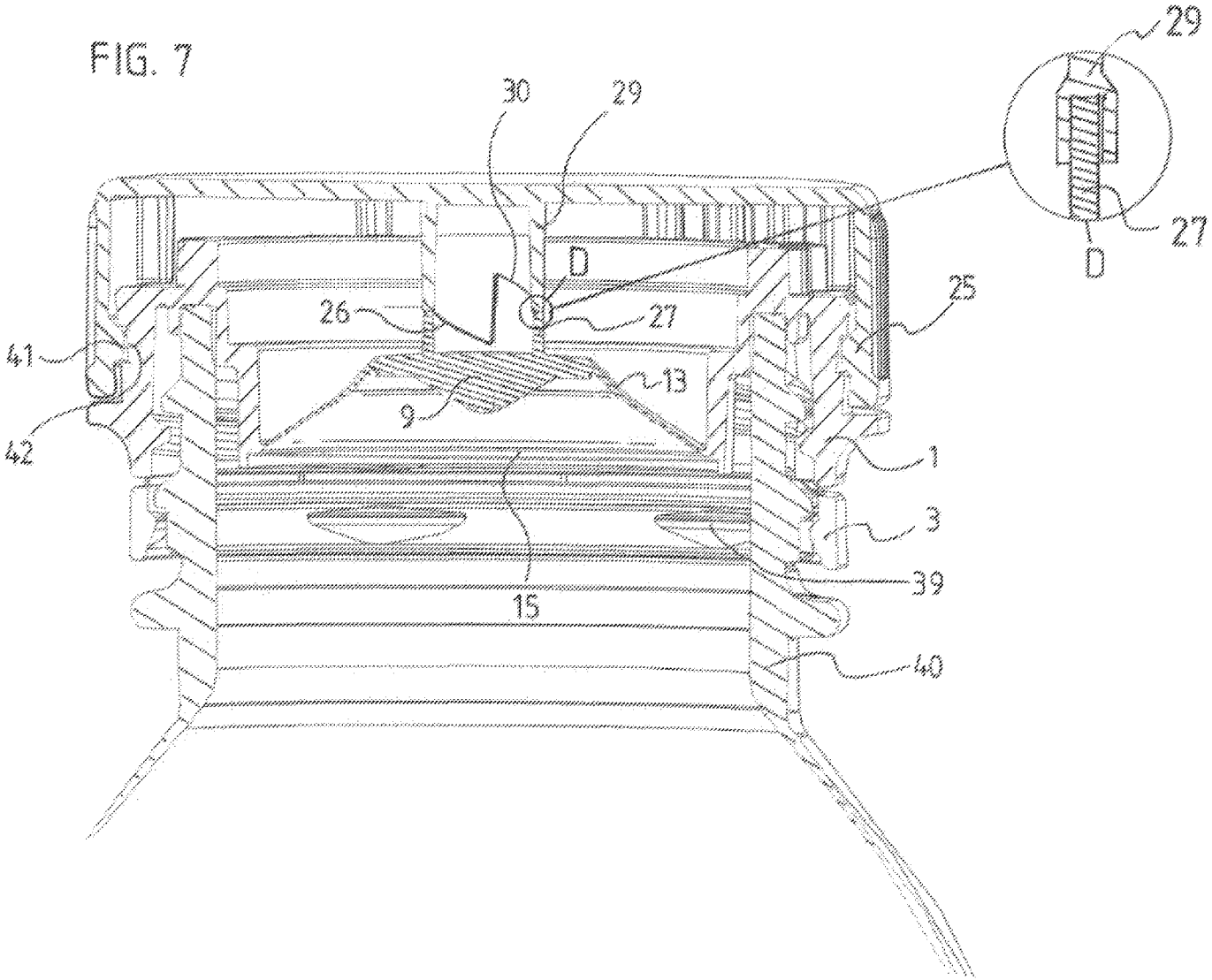
Figure 8:
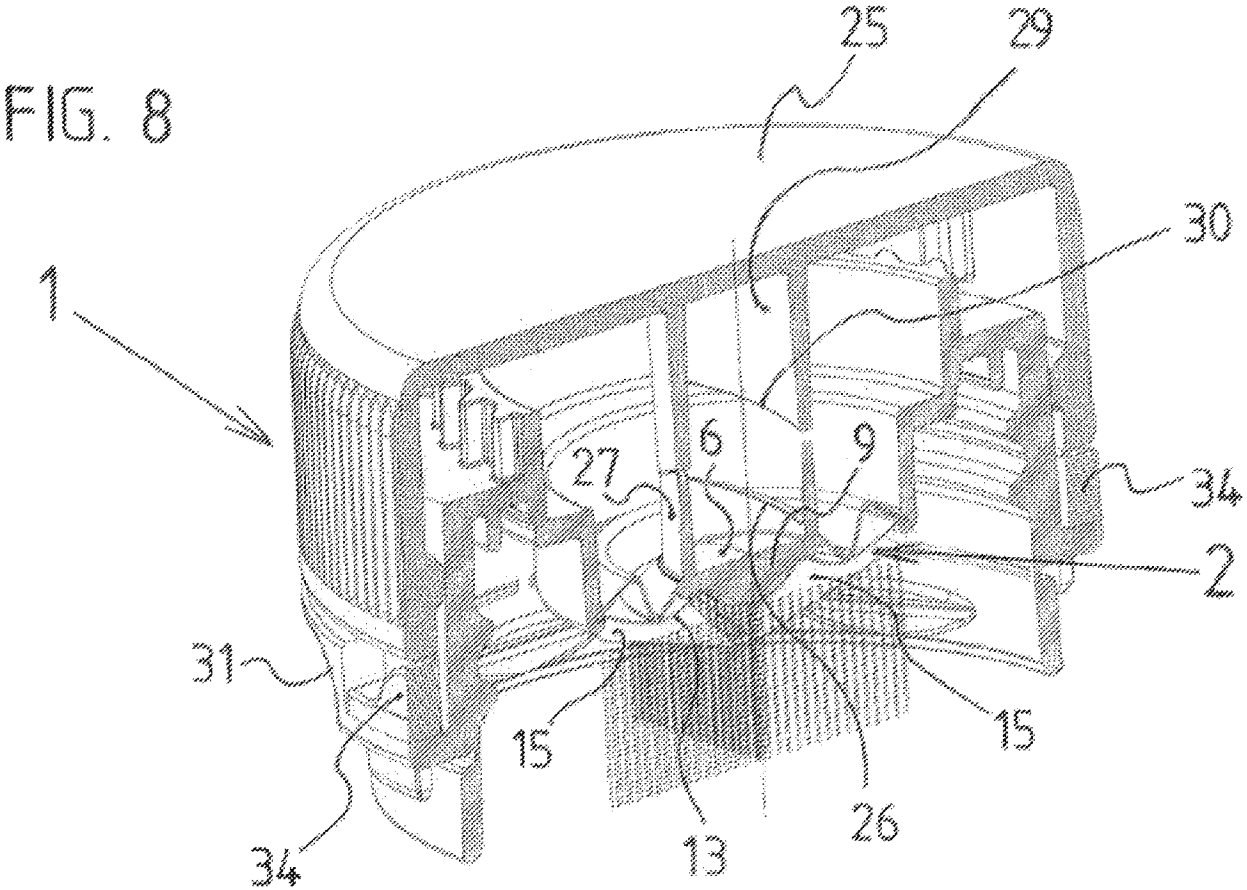

The figures show the following:

FIG. 1 An initial variant with direct operation of the capsule emptying process presented in a perspective cross-section;

FIG. 2 The closure with the appropriate separately filled capsule prior to its insertion;

FIG. 3 The closure presented in a perspective cross-section and, in addition, the beadable edge of the capsule that can be inserted from the bottom for its safety as detailed solution A and, alternatively, a barbed hook to hold the capsule as detailed solution B;

FIG. 4 This closure after the push-button is pressed down and the capsule is emptied;

FIG. 5 A solution for the tamperproof guarantee at this closure;

FIG. 6 A second variant of the closure with indirect operation of the capsule emptying process by turning an additional twist cap presented in a perspective cross-section;

FIG. 7 This closure according to FIG. 6 shown in a cross-section in magnified view;

FIG. 8 The closing cap according to FIGS. 6 and 7 after indirectly operating the capsule emptying process.

Figure 9:
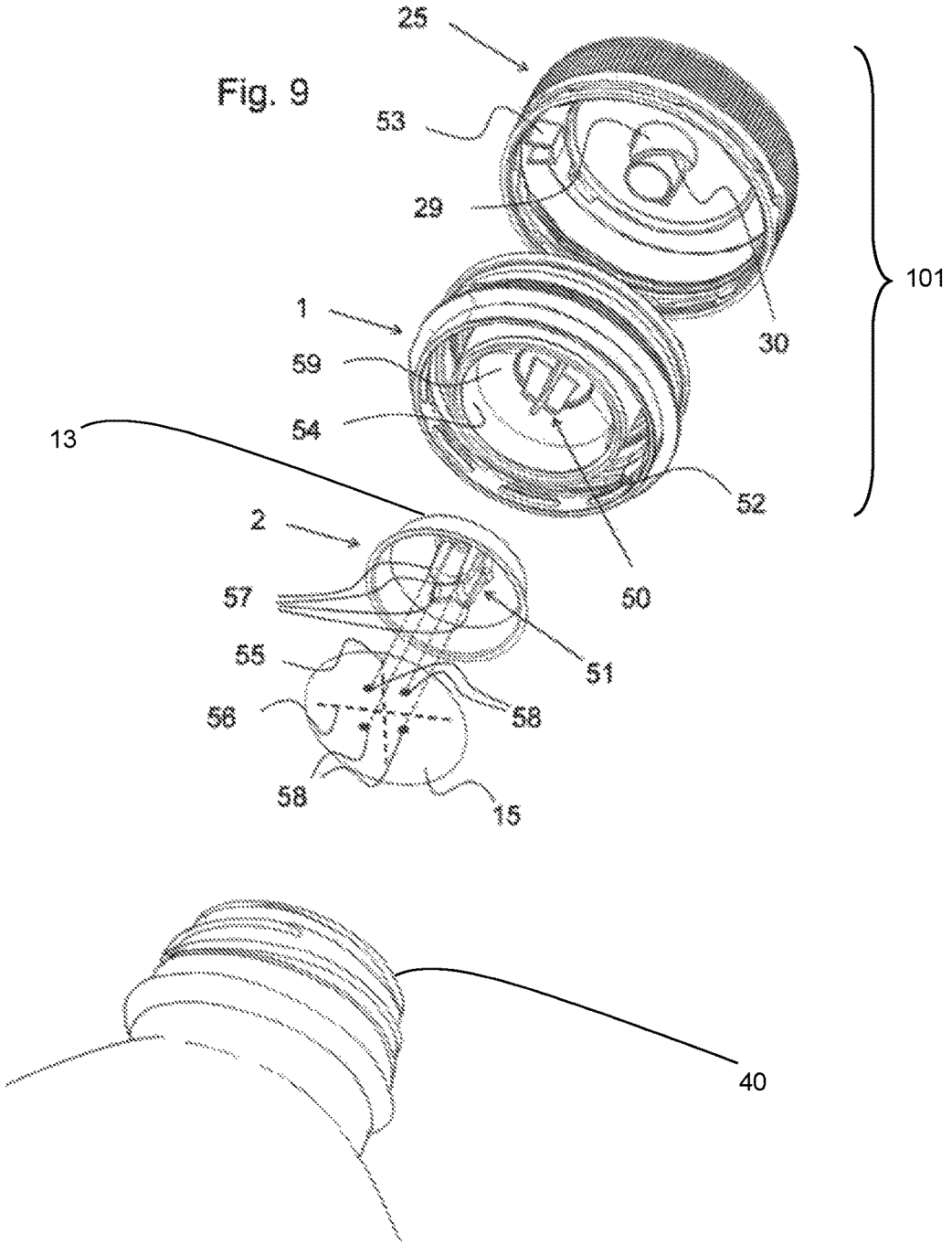
Figure 10:
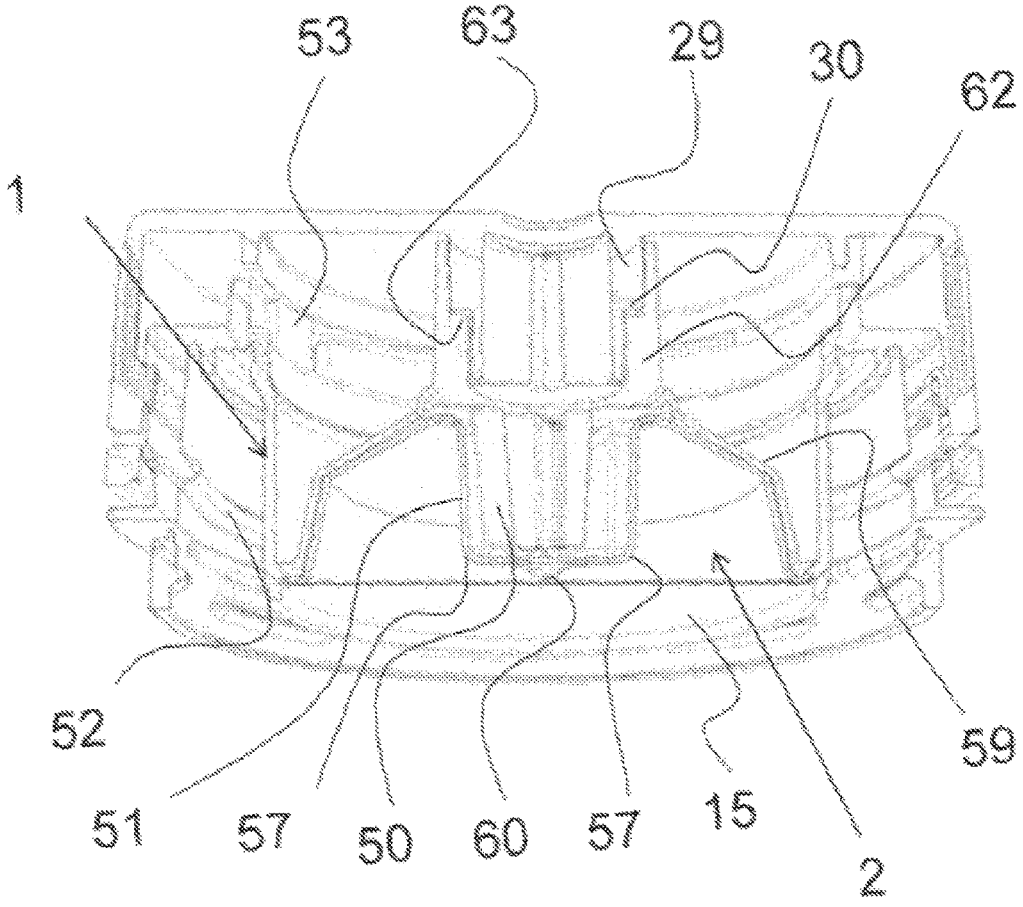
Figure 11:
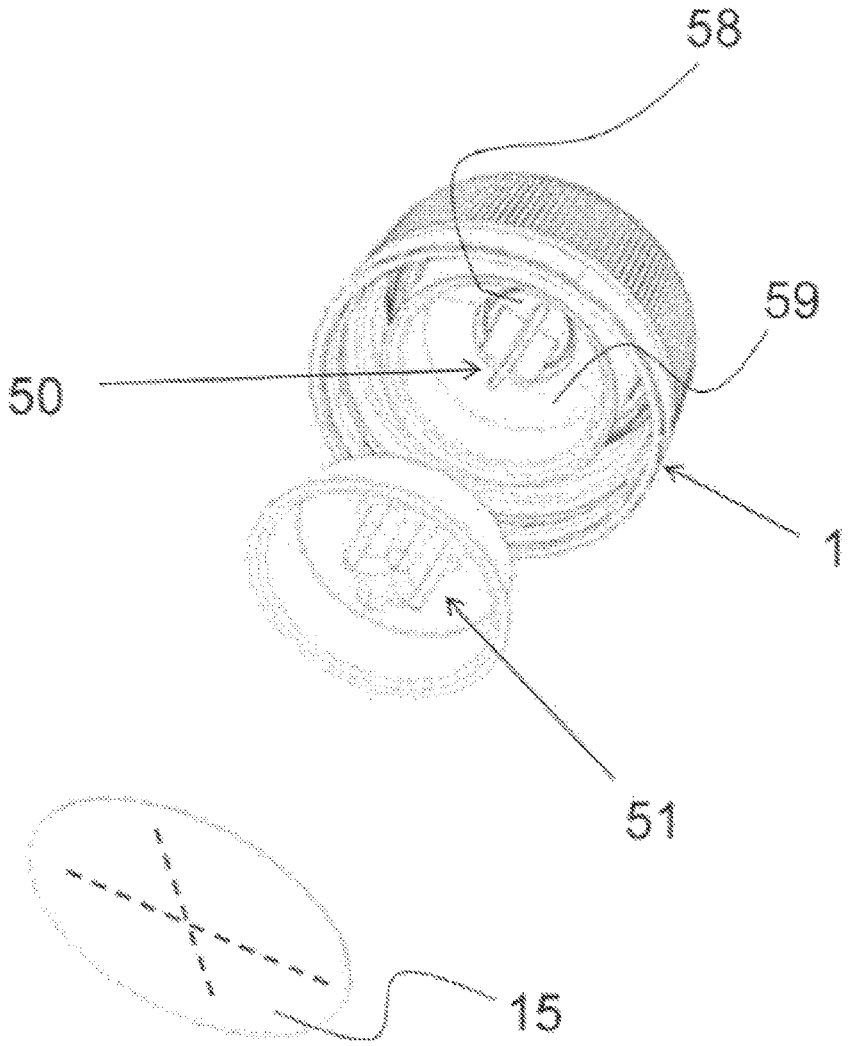
Figure 12:
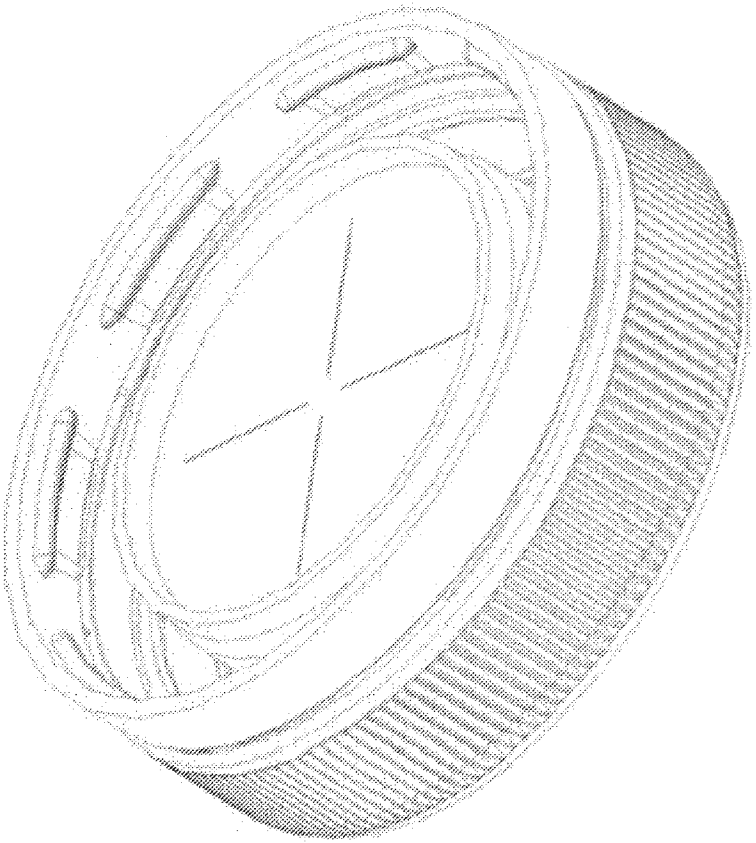

FIG. 9 An execution of the closure with a knob in the shape of a crosswise profile and with a capsule with an indentation that fits this knob in its upper face and crosswise weakened lines in its sealing film, to be operated by twisting;

FIG. 10 The closure according to FIG. 9 in assembled state is shown in a cross-sectional view;

FIG. 11 An execution of the closure with a knob in the shape of a crosswise profile and with a capsule with an indentation that fits this knob in its upper face and crosswise weakened lines in its sealing film, to be operated by means of a push button;

FIG. 12 The closure according to FIG. 9 or 10 with inserted capsule in the still closed state of the capsule.

FIG. 1 shows an initial variant of this closure which makes it possible to empty the separately filled and inserted capsule with a single direct operation. The closure comprises a closing cap 1 with internal thread 7 so that it can be screwed onto a threaded neck of a container. The lower edge of closing cap 1 features a circumferential strip 3 which is connected to closing cap 1 via a thin point 5. This strip 3 offers a tamperproof guarantee and remains at the bottle nozzle while closing cap 1 is screwed off when opening the bottle for the first time, and thin point 5 rises. Closing cap 1 features an indentation 8 on its upper face, i.e. an indentation of the lid surface. This lid surface is designed in the shown example as a beak-shaped push button 4 that can be deformed in axial direction and the flattened tip of which forms a circular pusher surface 6. Pusher surface 6 is shaped into a protuberance 9 on its lower face and the wall of push button 4 is proportionally thin in design so that push button 4 can be pressed down in axial direction from the convex moulding as seen from above by exerting pressure on pusher surface 6 while the wall of the push button deforms. Push button 4 can thereby be pressed down in the shape of concave. The outer edge on the lower face of push button 4 forms a circumferential shoulder 10 that protrudes downward. A circular capsule 2 can be attached to this shoulder 10 from the bottom. The outer edge of the capsule then rests in an accurately fitting manner against this shoulder 10 and is retained on this shoulder by a beading 14. This capsule 2 in itself consists of a dome-like upper part that ends in a flat projection 12 on top and at the bottom at the outer edge. An indentation 11 is formed in the centre of the upper part and protuberance 9 fits into place at push button 4. This dome-like upper part, which still forms a separate part, is toppled over and takes on the shape of a bowl for filling purposes. This bowl is filled and afterwards sealed with a film 15 in the shape of a circular disc against a capsule 2. Afterwards, capsule 2 is hermetically sealed. As a result, even sterile filling and sealing is guaranteed. When the dome-like upper part contains an aluminium foil and film 15 contains this as well, capsule 2 will even be airproof and also lightproof. This opens up the possibility of filling with the most sensitive and photosensitive content.

FIG. 2 shows the closure with the appropriate separately filled capsule 2 with its curved upper part 13 prior to its insertion. It is inserted from the bottom in closure 1 with convex upper face 13 in front. Capsule 2 is flat on its lower face and is sealed by film 15. This film 15, which is illustrated separately under capsule 2, is provided with weakened lines 45 so that it is purposefully broken along these weakened lines 45, as described later on. Weakened lines 45 can also form a star with three lines instead of a cross which is shown below in a further variant. Film 15 is applied on projection 12 while upper part 13 is fitted and is welded or sealed with this projection. Convex upper face 13 features an indentation 11 in the centre into which protuberance 9 is intended to extend at closing cap 1. A tamper evident band 3 is visible at the lower edge of cover lid 1. This seal is integrally shaped via a continuous thin point 5 or via a few material bridges 16. Thin point 5 is sheared off when closing cap 1 is screwed off later on or when material bridges 16, which are designed as predetermined breaking points, break and release closing cap 1 that has to be screwed off.

FIG. 3 shows an initial solution under detail A as to how capsule 2 can be contained in closing cap 1. For the purpose of fastening capsule 2 on downward protruding shoulder 10 on the lower face of the dome-like arch 4, this shoulder 10 features a wall attachment 17 standing vertical on this shoulder at its outer edge in this solution. This wall attachment reaches the closure in axial direction. After capsule 2 has been inserted, wall attachment 17 is flipped inwards in warm state against the centre of the closure, as sketched with an arrow, and is pressed on film 15 and cooled. Henceforth, capsule 2 is safely contained in closure 1 because of the resulting beading 14. Alternatively, the capsule 2 is friction-locked in the closing cap 1 by means of barbed hooks 43 at the closing cap 1. For example, a number of barbed hooks 43 can be integrally formed at wall attachment 17 distributed over the circumference as shown in detailed solution B. The edge of capsule 2 can then be clicked onto this barbed hook 43 whereupon it is secured in this position.

FIG. 4 shows the closure after pressing down pusher surface 6 as seen in a perspective cross-section. As a result of pushing down pusher surface 6 and push button 4 with it in axial direction, protuberance 9 pushes on the underlying indentation 11 in upper face 13 of inserted capsule 2. Consequently, the content of capsule 2 presses from within on its lower face, i.e. from within on film 15. If the pressure is sufficiently increased, film 15 will break or tear under the resulting expansion along weakened lines 45 and the content of the capsule falls down completely out of the capsule.

FIG. 5 shows an initial solution for the implementation of a tamperproof guarantee at this closure, as presented in FIGS. 1 to 4. When closing cap 1 is namely produced as is shown in the previous figures, anyone can push down openly accessible pusher surface 6 and empty capsule 2 in the contents of a bottle. Hence, pusher surface 6 could be pushed down improperly: Anyone could simply push down pusher surface 6 in a series of bottles on a shelf as a practical joke. The inhibition threshold for that is relatively low. To avoid this, the edge of closing cap 1 displayed here features an integrally formed hinging cover 18. A latch 20 is integrally formed as a pickup element at the outer edge of cover 18, i.e. on the side of cover 18 opposite hinge 19. If cover 18 changes side and swivels down (i.e., pivots down) on closing cap 1, latch 20 will hook into window 22 at a strip 21 that is integrally formed there. Henceforth, cover 18 can only be swung open and the access to push button 4 and its pusher surface 6 can only be released when, at first, strip 21 is torn off from closing cap 1. To this end, strip 21 is integrally formed via a thin point 23 at the upper outer edge of closing cap 1. Strip 21 can be grasped at pull tab 24 and torn off along the circumference of closing cap 1 while thin point 23 breaks. To avoid discarding strip 21 carelessly, thin point 23 can be designed in such a way that it does not stretch across the entire length of strip 21 so that it remains secured to closing cap 1 after being partially torn loose but still releases latch 20 so that cover 18 can be swung open. Overall, the entire closure solution consists of three parts, namely lid cap 1 with its integrally formed cover 18 in one piece for the tamperproof guarantee, separately fillable capsule 2 which, in turn, consists of two parts, namely dome-like upper face 13 as bowl-shaped moulded part and film 15 to close the capsule. Altogether, it consists of merely three parts!

FIG. 6 shows a second variant of the closure with indirect operation of the capsule emptying process presented in a perspective cross-section. The closure consists here of another additional moulded part, namely twist cap 25 which is used to operate the closure indirectly. The closure underneath this twist cap 25 is practically identical to the closure presented in FIGS. 1 to 4, with only the following exceptions: A helix-shaped actuating surface 26 is implemented above push button 4 and its pusher surface 6 of closing cap 1 whereby a tube section 27 is integrally formed on top of push button 4 that extends upwards from pusher surface 6. The top end of this tube section 27 forms two helix-shaped sections as actuating surfaces 26. Only one of those surfaces is visible due to the sectional view. Lower face 28 of overlying twist cap 25 contains an equal tube section 29 in axial direction of which the helix-shaped sections 30 are attached to lower tube section 27 in a form-fitting manner. Both tube sections 27, 29 are advantageously on top of one another as the edge of one section forms a groove in which the edge of the other tube section engages as a tongue, as is shown based on a detail drawing in FIG. 7. Twist cap 25 is pushed from the top via closing cap 1 so that circumferential strip 44 latches on the outside of closing cap 1. Afterwards, twist cap 25 is secured on closing cap 1 and also secured against twisting. Elements 34 are used for this purpose. These are supported on their lower face by a thin wall 32 and are shaped at the top in an arched ridge 31 and are connected with twist cap 25 via a thin point 33. Twist cap 25 is also shaped like an arch at its lower edge 35 of this arched ridge 31, thus at the position of this arched ridge 31. If twist cap 25, as seen from above, is turned counterclockwise, thus in loosening direction, thin point 33 is broken first and elements 34 with their arched ridge are afterwards pushed down as a result of striking the arched lower edge section of twist cap 25 in axial direction while thin walls 32 underneath elements 34 are deformed. This requires a certain amount of force. Twist cap 25 can only be further turned in the loosening direction when elements 34 have been sufficiently pushed down. The helix-shaped actuating surface 26, 30 of tube sections 27, 29 affect one another in such a way that tube section 26 is pressed down and therefore actuates push button 6, i.e. push button 6 as well as capsule 2 are pushed down which results in the expansion and finally bursting of film 15 along its weakened lines. In order for twist cap 25 to only turn in the loosening direction, it features a slightly flexible tooth mechanism 36 on the inside of its cover. This tooth mechanism engages another tooth mechanism 37 which is formed on the outside at an axial extension 38 at the closing cap and the teeth of which slant in the loosening direction so that they function as barbed hooks. As a result, twist cap 25 can only turn in the loosening direction with a rattle and tooth mechanism 37 blocks a clockwise rotation of twist cap 25.

In addition, we recognise engaging elements 39 at tamper evident band 3 in FIG. 6. When the closure is loosened for the first time over a bottle nozzle, these engaging elements 39 will snap in place via a corresponding projecting bulge at the bottle or container nozzle. Afterwards, the closure can only be loosened from the neck by breaking thin point 5 between tamper evident band 3 and upper closure part 1.

FIG. 7 shows this closure according to FIG. 6 presented in a cross-section in enlarged view. Additionally, neck 40 is shown with which the bottle or container is equipped. It is clearly recognisable from this illustration how twist cap 25 is kept on closing cap 1 of the closure. For this purpose, the upper region of the exterior of closing cap 1 has a circumferential groove 42 in which a circumferential bead 41 will end up on the inside of twist cap 25 during snap-on and keeps twist cap 25 rotatable and securely in place on closing cap 1. Furthermore, it is shown as detail D next to the closure how both tube sections 27, 29 can be on top of one another so that their edges remain securely on top of one another and cannot slide laterally off from one another. For this purpose, one edge contains a groove so that the opposite edge is guided therein as a tongue. It also suffices when the exterior of a tube section is extended so that a support is formed outside for the other tube section and thus, to some extent, forms a groove with just one limiting wall.

Finally, FIG. 8 shows the closing cap according to FIGS. 6 and 7 after indirectly actuating the capsule emptying process and prior to removing closing cap 1 of the closure as shown in a perspective cross-sectional view. Elements 34 have been pushed down and, hence, twist cap 25 can be turned further counterclockwise while it is secured against an axial movement caused by the bouncing of bead 41 and groove 42, as described in FIG. 7. Tube section 28 and its helix-shaped actuating surface 30 integrally formed on the lower face of twist cap 25 affected helix-shaped actuating surface 26 at tube section 27, which sits on pusher surface 6. Hence, push button 4 was pushed down and protuberance 9 at the lower face of pusher surface 6 pressed upper face 13 of capsule 2 from a convex to concave shape. The stretching of film 15 that is produced as a result thereof causes it to break along its weakened lines and the content is distributed downward or emptied as specified here.

An embodiment as shown in FIG. 9 in an exploded drawing along the axis of rotation of the fillable closure 101 proves to be particularly advantageous and safe. This is a closure which is actuated by rotation of the closing cap with its twist cap in the loosening direction. Twist cap 25 is pushed from the top (i.e. snapped-on) via closing cap 1. Closing cap 1 is equipped with an internal thread 52 with which it can be screwed onto a bottle thread. The lower face of twist cap 25 shows an integrally formed tube section 29 that extends downward in axial direction. It features helix-shaped sections 30 that rest on just those sections in a form-fitting manner that are present on a tube section that is not visible here at the upper face of cap 1. The lower face of cap 1 shows the formation of this tube section at the lower face. This formation here is the protuberance in the shape of a cross profile 50. This cross profile 50 fits into an indentation 51 that is essentially also shaped like a cross profile in the upper face of associated capsule 2. Cap 1 is equipped with a cylindrical downwardly projecting edge 54 so that a receiving cylinder is formed in which capsule 2 can be inserted from the bottom and so that its indentation 51 in the shape of a cross profile is placed over cross profile 50. The lower edge of filled capsule 2 is closed with sealing film 15. Sealing film 15 features two intersecting weakened lines 55, 56 which divides sealing film 15 nearly up to its edge into four circular segments. The function of this closure after sealed capsule 2 is inserted in cap 1 and twist cap 25 is pushed through the same and after the closure as a whole has been screwed with internal thread 52 of cap 1 via a container thread is described as follows: Twist cap 25 is turned in the loosening direction, thus counterclockwise when seen from above. As a result, tube section 29 is turned and pressed with its helix-shaped shoulders 30 on those of the tube section on the upper face of cap 1. Hence, its tube section is pressed downward in axial direction as the upper face of cap 1 deforms. Cross profile 50 is thus pushed down. As a consequence, indentation 51 in the shape of a cross profile in the upper face of capsule 2 is pushed down in an axial downward direction. Finally, the lower end of indentation 51 abuts on the inside of sealing film 15 and places it under tensile stress. The bearing pressure of indentation 51 on sealing film 15 and thus also the generated tensile stress increase when turning further at twist cap 25 until sealing film 15 finally breaks along its weakened lines 55, 56. It is now very crucial that the four outer corners 57 of the indentation are placed on the centre and/or the bisectors of the four circular segments on sealing film 15. Only then do we have the effect that indentation 51, which is pushed down, swivels downward these four segments like individual sheets and keeps these in this swivelled out position. If these corners 57 would namely be incident on weakened lines 55, 56 themselves, indentation 51 would plunge with its cross-shaped profile in the opened fracture lines of sealing film 15 and mostly close and plug the resulting opening. That is why it is very important that these corners 57 are incident on the bisector of the individual circular segments on which points 58, which are marked at the sealing film, abut. Once sealing film 15 is broken and indentation 51 has pushed down the central corners of the individual circular segments, the capsule content can flow or fall down. When twist cap 25 turns further in the loosening direction, driver 53 at twist cap 25 will come into action. This driver 53 takes along closing cap 1 and screws it therefore off the bottle or container thread so that the entire closure is finally removed from the bottle or container and the threaded neck 40 is exposed. The closure can be put freely on the neck again and closing cap 1 is screwed tightly onto the neck seal of the bottle or container again by turning twist cap 25 in the closing direction.

FIG. 10 shows this closure according to FIG. 9 in assembled state and shown in a cross-sectional view. In addition to what is previously described, we observe here the equivalent of tube section 29 with its helix-shaped sections 30, namely tube section 62 with the also helix-shaped sections 63 at deformable upper face 59 of cap 1. Furthermore, we can see cross profile 50 that sits in indentation 51 and which, in turn, features four cross-shaped corners 57. Indentation 51 may feature a downwardly projecting knob 60 in the centre which is the first one to press on sealing film 15 when descending and separates it at the intersection of its weakened lines.

FIG. 11 shows another embodiment of the closure having essentially the same opening function for sealing film 15. In contrast to the embodiment according to FIG. 9, cross profile 50 is not pushed down by turning the twist cap but by simply pressing down a push button 58 on the upper face of closing cap 1. For this purpose, the closing cap features a upper face 59 that recesses upwards and which forms a pusher surface of push button 58 in the centre. When pressing this pusher surface from above, push button 58 is pushed down in axial direction with cross profile 50 that is integrally formed on its lower face. This, in turn, pushes down indentation 51 in the upper face of inserted capsule 2, which causes sealing film 15 to burst whereby, in turn, the four outer corners of indentation 51 in the shape of a cross profile swivels downward the four thus formed circular segments of sealing film 15 and keeps these in the downwardly swivelled position. The axially downward projecting profile of the closing cap can be an axially downward projecting triangular or cross-shaped profile, and the indentation can be a triangular or star-shaped indentation.

FIG. 12 shows the closure according to FIG. 9 or 10 with inserted capsule in the still closed state of the capsule as a whole. It can be distributed in this shape and can be screwed onto any container or bottle with a matching external thread.

The invention claimed is:

1. A fillable closure to trigger the emptying of a separately filled capsule that is part of the closure, wherein the closure comprises a closing cap that can be screwed onto a threaded neck of a container and in which the separately filled capsule with a downward facing sealing film can be inserted in closed condition from the bottom, wherein an upper face of the inserted capsule is deformable in design and can be pushed down in an axial direction so that the downward facing sealing film of the capsule breaks or bursts, wherein the separately filled capsule is configured to be filled with contents separately from the closure, and is inserted into the closing cap, wherein the sealing film includes a foil that is airproof and lightproof, wherein an axially downward projecting indentation is formed in the upper deformable face of the capsule, wherein an axially downward projecting profile at a lower inner side of the closing cap fits from above into the indentation consistent with a cross-section of the axially downward projecting profile in the deformable upper face of the inserted capsule, so that the deformable upper face of the inserted capsule can be pushed down with the indentation for the downward projecting profile so that outer lower corners of the indentation are pressed onto the sealing film of the capsule on a side of the sealing film inside the capsule to place the sealing film under tensile stress, and wherein the sealing film includes weakened lines so that the corners are incident on the bisectors of circular segments formed by the weakened lines due to the downward projecting profile passing through the sealing film, and these circular segments can be pivoted down from the corners after bursting the weakened lines and maintained in the downward pivoted position by the downward projecting profile.

2. Fillable closure to trigger the emptying of the separately filled capsule that is part of the closure according to claim 1, wherein the downward projecting profile forms a cross in its cross-section profile and is integrally formed at the lower face of the closing cap, which cross profile fits in the indentation in the shape of a cross profile in the deformable upper face of the inserted capsule, and wherein, by pressing the cross profile along a turning axis of the closing cap, the indentation in the shape of a cross-profile and its outer lower corners, onto which the cross profile can be pressed, press on the sealing film of the capsule for initially tensioning the sealing film, and wherein the sealing film features two intersecting weakened lines which cross between the outer lower corners so that the corners are incident on the bisectors of the four formed circular segments marked by the weakened lines, and these weakened lines will burst by pressing these lower four corners onto the sealing film in between the weakened lines, and after bursting the four circular segments will be swivelled downward by the corners and afterwards will be kept in the downward swivelled position.

3. The fillable closure to trigger the emptying of the separately filled capsule that is part of the closure according to claim 1, wherein the closing cap is equipped with a twist cap pushed from the top which includes an axially downward projecting tube section with helix-shaped sections on its lower face, wherein these sections rest friction-locked on such equal sections that are present at a tube section at the deformable upper face of the closing cap, so that by turning the twist cap in a counterclockwise direction when seen from above, the tube section friction-locks with the tube section at the deformable upper face of the closing cap and presses the downward projecting cross profile in a downward direction while deforming the surrounding upper face of the closing cap so that the cross profile finally emerges into the indention on the upper side of the capsule and its four corners are pressed onto the sealing film at bisectors of the intersecting weakened lines and thereby break the sealing film along the weakened lines.

4. The fillable closure to trigger the emptying of the separately filled capsule that is part of the closure according to claim 1, wherein the closing cap includes a deformable upper face that forms a push button in the centre so that the axially downward projecting cross profile at the lower face of the closing cap can be moved downward by pressing the push button and the cross profile and thus into the indentation on the upper side of the capsule, wherein the outer lower corners of the same can be pressed on the sealing film of the capsule, and wherein the sealing film includes two intersecting weakened lines so that the corners are incident on the bisectors of the four formed circular segments and the same can be pivoted down from the corners after bursting the weakened lines and maintained in the downward pivoted position.

5. The fillable closure to trigger the emptying of the separately filled capsule that is part of the closure according to claim 1, wherein the closing cap is equipped with a twist cap pushed from the top which includes an axially downward projecting tube section with helix-shaped sections on its lower face, wherein these sections rest friction-locked on such sections that are present at a tube section at the deformable upper face of the closing cap, so that by turning the pushed twist cap, as seen from above, counterclockwise to the tube section at the upper face of the closing cap while its upper face deforms, the cross profile can be moved in an axial downward direction, and wherein an axially downward projecting tube is integrally formed underneath the tube section at the lower face of the closing cap, which fits in a cylindrical indentation in the deformable upper face of the inserted capsule, and by pushing down the tube and thus the indentation, the outer lower corners of the lower edges of the indentation can be pressed on the sealing film of the capsule.

6. The fillable closure to trigger the emptying of the separately filled capsule that is part of the closure according to claim 1, wherein the closing cap includes a deformable upper face, which forms a push button in the centre, wherein an axially downward project tube section is integrally formed at the lower face of the closing cap, which fits into a cylindrical indentation in the deformable upper face of the inserted capsule, and wherein, by pushing down the tube section and thus the indentation, the outer lower corners of the lower edges of the indentation can be pressed onto the sealing film of the capsule.

7. The fillable closure to trigger the emptying of the separately fillable capsule that is part of the closure according to claim 1, wherein the closing cap is equipped with twist cap that is snapped-on from above, which includes an axially downwardly projecting tube section on its lower face with helix-shaped sections, which rest on such sections in a form-fitting manner, which are present at a tube section at the deformable upper face of the closing cap and which can be moved downward in an axial direction by turning the snapped on twist cap, as seen from above, counterclockwise to the tube section at the upper deformable face of the closing cap while said upper face deforms, wherein the axially downward projecting profile of the closing cap is an axially downward projecting triangular or cross-shaped profile that is integrally formed underneath the tube section at the lower face of the closing cap, which fits in the indentation of the inserted capsule, which is a triangular or star-shaped indentation in the deformable upper face of the inserted capsule, so that by pressing down the triangular or star-shaped profile and thus the indentation, the outer lower corners of the lower edges of the indentation are pressed onto the sealing film of the capsule, and so that the sealing film includes weakened lines in the shape of a star so that the outer corners of the indentation are incident on the bisectors of the three formed 120° circular segments of the sealing film and the same can be pivoted downward from the corners after bursting the weakened lines and maintained in the downward pivoted position.

8. Fillable closure to trigger the emptying of the separately filled capsule that is part of the closure according to claim 1, wherein the closing cap features a deformable upper face that forms a push button in the centre wherein an axially downward projecting triangular or star-shaped profile in cross-section is integrally formed at the lower face of the closing cap, which fits in a triangular or star-shaped indentation in cross-section in the deformable upper face of the inserted capsule, and wherein, by pressing the triangular or star-shaped profile and thus the indentation, the outer lower corners of the indentation can be pressed on the sealing film of the capsule, and wherein the sealing film features radial weakened lines, each weakened line being separated from adjacent weakened lines by 120°, so that the outer corners of and, as a result, a lower tube section actuates the pusher button so that the push button can be pushed through pressure from the top while, at first as seen from above, the convex shape deforms into a concave shape in axial direction so that the protuberance pushes down the upper face of the capsule and its content and the film, which forms the lower face of the capsule, can be placed under tensile stress as a result thereof so that the film breaks or bursts along its weakened lines.

9. Fillable closure to trigger the emptying of the separately fillable capsule that belongs to the closure and can be inserted in the closure according to claim 1, wherein a twist cap pushed from above over the closing cap as a circumferential bead snaps at its interior into a circumferential groove on the exterior of the closing cap.

10. Fillable closure to trigger the emptying of the separately fillable capsule that belongs to the closure and can be inserted in the closure according to claim 1, wherein the twist cap is secured against twisting by elements with upward arched ridge wherein the lower edge of the twist cap features arched notches that fit accurately on the ridges of the elements and wherein, when turning the twist cap, the elements can be shifted downward while the thin points on which they rest deform and while the twisting of the twist cap is enabled.

11. Fillable closure to trigger the emptying of the separately fillable capsule that belongs to the closure and can be inserted in the closure according to claim 1, wherein the twist cap together with the closing cap form a joint tooth mechanism wherein teeth of at least one of the tooth mechanisms in the loosening direction are slanted in the rotating direction so that they function as barbed hooks and that, as a result thereof, the twist cap can only be turned in the loosening direction.

12. Fillable closure to trigger the emptying of the separately fillable capsule that is part of the closure and can be inserted in the closure according to claim 1, wherein the capsule is kept in the closing cap by a beading of its edge that is folded around its edge from the outside.

13. Fillable closure to trigger the emptying of the separately fillable capsule that is part of the closure and can be inserted in the closure according to claim 1, wherein the capsule is friction-locked in the closing cap by means of barbed hooks at the closing cap.

* * * * *